United States Patent [19]

Bertini

[11] Patent Number: 4,986,478

[45] Date of Patent: Jan. 22, 1991

[54] INJECTION VALVE

[75] Inventor: Paolo Bertini, Via Di Salviano, Italy

[73] Assignee: Siemens Aktiengesellschaft, Berlin and Munich, Fed. Rep. of Germany

[21] Appl. No.: 466,255

[22] PCT Filed: Jun. 30, 1988

[86] PCT No.: PCT/DE88/00396

§ 371 Date: Mar. 1, 1990

§ 102(e) Date: Mar. 1, 1990

[87] PCT Pub. No.: WO89/00244

PCT Pub. Date: Jan. 12, 1989

[30] Foreign Application Priority Data

Jul. 1, 1987 [DE] Fed. Rep. of Germany ... 8709111[U]

[51] Int. Cl.[5] ..... F02M 61/18; F02M 51/08

[52] U.S. Cl. ..... 239/585; 239/533.12

[58] Field of Search ..... 239/533.12, 585, 601, 239/596

[56] References Cited

U.S. PATENT DOCUMENTS 4,099,494 7/1978 Goloff et al. .
4,339,082 7/1982 Radaelli et al. .
4,666,088 5/1987 Krauss et al. .

FOREIGN PATENT DOCUMENTS 344270 11/1921 Fed. Rep. of Germany .
3415905 7/1985 Fed. Rep. of Germany .
2016592 9/1979 United Kingdom .

*Primary Examiner*—Andres Kashnikow
*Assistant Examiner*—Lesley Morris
*Attorney, Agent, or Firm*—Hill, Van Santen, Steadman & Simpson

[57] ABSTRACT

An injection valve as a nozzle opening 53 at the end of a cylindrical line 52, this nozzle opening 53 being formed by a central opening 530 and by peripheral openings 531 grouped therearound. As a result thereof, a fuel jet having a highly articulated and therefore very large surface arises during ejection, this promoting the evaporation of the ejected fuel.

11 Claims, 2 Drawing Sheets

INJECTION VALVE

Figure 1:
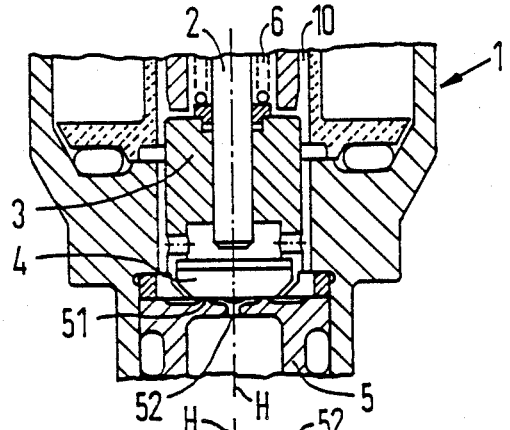

The invention is directed to an injection valve for injecting fuel into an intake line of an internal combustion engine, wherein the valve includes a valve body that has an annular valve seat at the inside of the injection valve that is concentric with a principle axis, has a closing part that is arranged displaceable along the principle axis, that is pressed against the valve seat by a spring and that is lifted off from valve seat with an electro magnet. A cylindrical line or conduit bore that penetrates the valve body from inside the valve seat from inside to outside and that discharges at the outside into a nozzle opening is also provided. For example, German published application No. 34 11 337 discloses such an injection valve. The fuel is thereby conducted via fuel delivery bores to a concentrating bore that has a significantly larger diameter and volume than the fuel delivery bores. The fuel should thereby emerge from the fuel delivery bores without wall contact and should subsequently impact onto the wall of the concentrating bore in order to flow to the end of the concentrating bore over this distributed film-shaped in roughly the shape of a parabola. A further concentrating bore following thereupon is executed such that its diameter diminishes to form an ejection section. The ejection section also has teeth directed toward the ejection end.

This embodiment is intended to avoid the formation of larger droplets of fuel, so that the fuel ejection ensues uniformly.

Further, German published application No. 34 15 905 discloses an apertured nozzle for internal combustion engines. The nozzle bore having a cylindrical shape is provided with a surface at a distance from its region at the intake side, this surface deviating from the cylindrical shape and acting as a disturbance for the fuel jet to be sprayed in order to thereby achieve a reduction of the combustion noises.

In comparison thereto, the object of the invention is to fashion an injection valve such that the quantity of ejected fuel evaporates better and faster.

The inventive solution of this object is achieved by an injection valve of the type first described above which has a closing part that is flat, a line or conduit that is cylindrical and has a constant diameter, and a nozzle opening that is formed by a central opening and by peripheral openings that surround the central opening, expand toward the outside, and are separated from one another by guide tabs. The peripheral openings and the guide tabs lie in an annular zone that is arranged between the central opening and the end of the line or conduit and that describes an acute angle of inclination of less than 90° with the principle axis. It is based on a special design of the nozzle opening on the basis whereof one succeeds in lending the ejected fuel jet a highly articulated and, thus, extremely large surface that promotes the evaporation of the fuel.

Advantage developments of the invention are achieved in an injection valve in which the guide tabs occupy at least a 30% of the area of the annular zone. Such injection valve preferably has the nozzle opening lying co-axially with the principle axis. In such injection valve, every peripheral opening is symmetrical relative to a secondary axis and the secondary axes of all peripheral openings proceed from the principle axis and have the same angular spacing from one another. Such angular spacing is of about 120° and there are three such peripheral openings. Another feature of the injection valve is that the end of every peripheral opening is limited by a semi-circular end wall or piece. In such injection valve to, lateral edges lying opposite one another proceed between the end wall of every peripheral opening and the central opening. Such injection valve has the lateral edges proceeding straight and two lateral edges of neighboring peripheral openings intersecting in a point on the circular central opening.

An alternate injection valve has the lateral edges as circular arches and the lateral edges of neighboring peripheral openings reaching the circular central opening at a distance from one another. In the present injection valve, the annular zone with the nozzle opening may be part of a separate nozzle member that is secured to the valve body. Such nozzle member may be a pressure diecast part.

Figure 2:
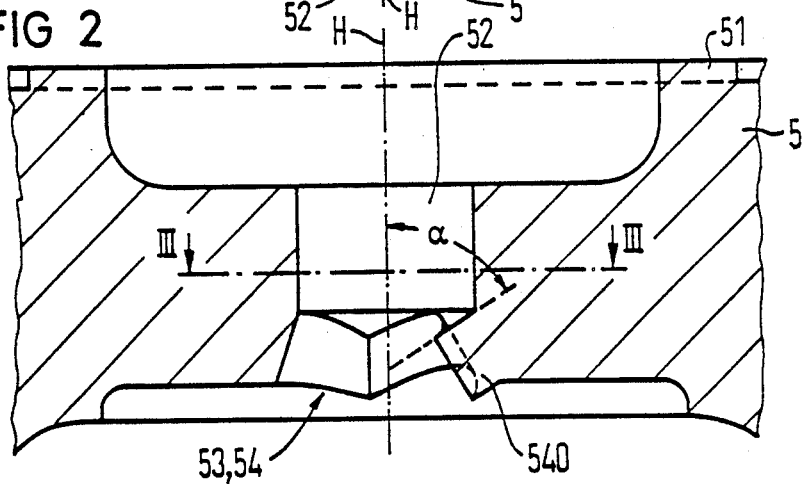
Figure 3:
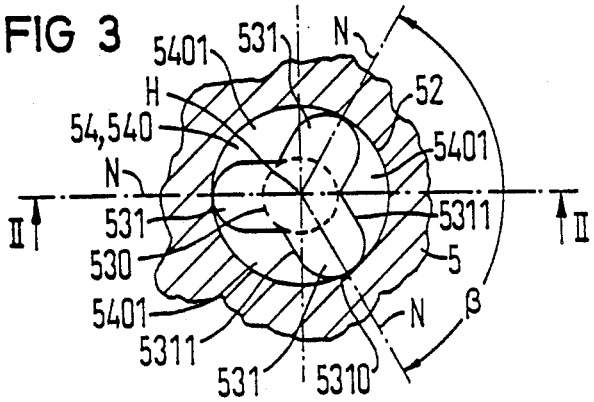
Figure 4:
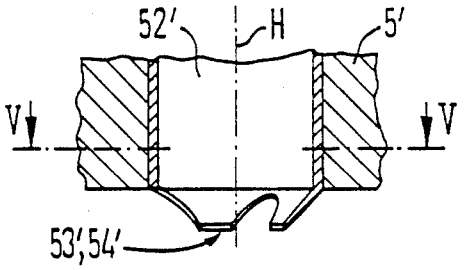
Figure 5:
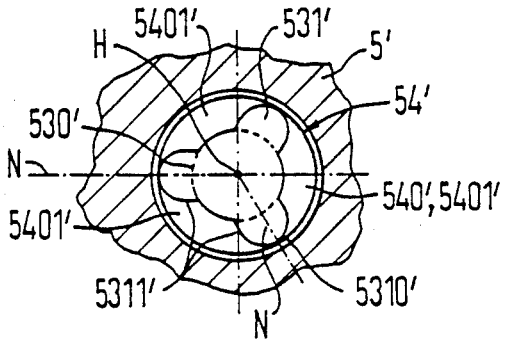
Figure 7:
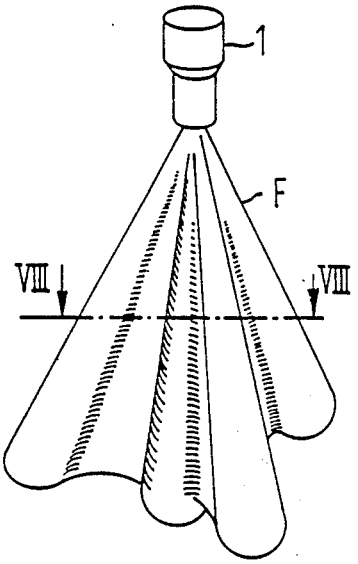
Figure 6:
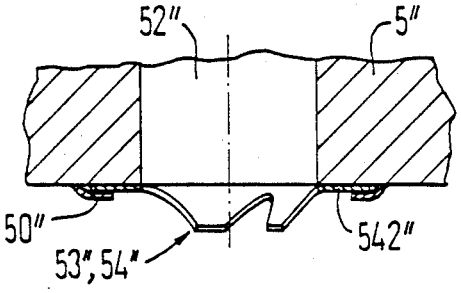
Figure 8:
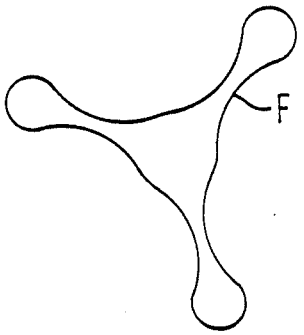

The invention shall be set forth in greater detail with reference to the FIGS. Shown are:

FIG. 1 a longitudinal section through a part of an injection valve;

FIG. 2 a partial view of the nozzle member of FIG. 1 in a greatly enlarged illustration;

FIG. 3 a partial section along the line III—III in FIG. 2;

FIG. 4 a partial section corresponding to FIG. 2 through a second embodiment of a valve body;

FIG. 5 a partial section along the line V—V in FIG. 4;

FIG. 6 a partial section like FIG. 4 through a further exemplary embodiment that differs from that of FIG. 4 on the basis of a different connection between nozzle member and valve body;

FIG. 7 a schematic view of the enveloping surface of the ejected fuel that can be achieved with an injection valve of the invention; and FIG. 8 a section through the fuel jet of FIG. 6 along the line VIII—VIII.

Apart from the special design of the nozzle aperture set forth with reference to FIGS. *2ff*, the injection valve 1 shown in FIG. 1 has a conventional structure. The housing thereof is only partially shown, the interior 10 thereof being terminated at one end by a valve body 5. This has a line or conduit bore 52 concentric to a principal axis H, this conduit 52 penetrating the valve body from the inside toward the outside and being surrounded by an annular valve seat 51 at the inside.

A guide pin 2 on which an armature 3 that carries a flat closing part 4 at one end is displaceably seated is arranged in the interior 10 concentrically with the principal axis H. The armature together with the closing part 4 are pressed down by a spring 6, so that the closing part 4 is seated on the valve seat 51 and, thus, suppresses the emergence of fuel from the interior through the conduit 52. For ejecting fuel, the armature 3 is drawn slightly upward with the assistance of an electromagnet (not shown) and the valve is thus opened. Without special measures, a compact fuel jet thereby arises having an essentially circular cross-section and a relatively small surface.

The invention succeeds in considerably enlarging the surface of the fuel jet. To this end, the nozzle opening 53 at the end of the line 52 has a special design that may be seen particularly clearly from FIGS. 3 and 5: it is formed of a circular central opening 530, 530' and by three peripheral openings 531, 531' that outwardly expand the central opening 530, 530' and that lie in an annular zone 540, 540' that extends between the central opening 530, 530' and the end of the line 52. The annular zone describes an angle $\alpha$ of inclination with the principal axis H that is smaller than 90° and preferably lies between 30° and 60°: the jet cone of the ejected fuel is all the larger the smaller this angle.

The peripheral openings 531, 531' are fashioned symmetrically relative to secondary axes N that have the same angular spacing $\alpha$ of 120° from one another. Every peripheral opening 531, 531' is limited at its end by a semicircular end piece or wall 5310, 5310' and by lateral edges 5311 that lie opposite one another and adjoin thereto. These lateral edges—executed straight according to FIG. 3—of neighboring peripheral openings respectively intersect in a point on the circular central opening 530: as a result thereof, roughly triangular guide tabs 5401 that reduce the diameter of the overall nozzle opening in comparison to that of the conduit 52 arise within the annular zone 540 between neighboring peripheral openings 531. As a result thereof, a peripheral jet 12 arises per peripheral opening 531 when ejecting the fuel, this peripheral jet 12 being connected to a central jet 14 via a narrow connecting section 16, as FIGS. 7 and 8 show. The surface of the overall jet resulting therefrom is obviously significantly larger than that of a compact jet having an essentially circular crosssection.

According to FIGS. 2 and 3, the valve body 5 and the nozzle member 54 comprising the nozzle opening 53 are of one piece and are composed of stainless steel because of the stressing of the valve seat 51. In contrast thereto, a separate nozzle member 54', 54'' is provided according to FIGS. 4–6, this being preferably a pressure diecast part (zinc pressure diecasting) and being capable of being manufactured in a simple way with high precision.

In the exemplary of FIGS. 4 and 5, the nozzle opening 53' is again formed by a circular central opening 530' and by three peripheral openings 531' extending radially outward therefrom, each of these peripheral openings 531' having a semicircular end piece or wall 5310' at the end. The lateral edges 5311' that, by contrast to the exemplary embodiments set forth above, represent a circular arc adjoin thereto. The radius of every peripheral opening is smaller than the exemplary embodiment set forth above, so that larger guide tabs 540' arise between the lateral edges 5311' of neighboring peripheral openings 531'.

The guide tabs preferably occupy at least 30% of the area of the annular zone, whereby the radial width of the annular zone lies between 20% and 50% of the radius of the conduit 52, 52'.

When, as in FIGS. 1–3, the valve body 5 and the nozzle member 54 are fashioned of one piece, the shape of this part can be realized with known fabrication techniques: the valve body can be cast or cold-worked. A combination of these two manufacturing steps is particularly expedient, whereby a cast valve body receives its ultimate shape and the exact dimensions with a following cold-working. It is also possible to plastically shape a valve body with a through continuous line with the assistance of a die placed at the nozzle opening, i.e. to press material from the region around the nozzle opening into the nozzle opening. It must thereby be taken into consideration that the diameter of the line 52 lies on the order of magnitude of only 1 mm; that, thus, FIGS. 2–6 show a roughly 40-fold magnification of the real situation.

A high precision can be most simply assured with the separate nozzle member 54', 54'' of a zinc diecast that, according to FIGS. 4 and 5, is connected to the valve body 5', 5'' with a nozzle tube 541' and, according to FIG. 6, is connected thereto with a nozzle flange 542''. In the former case, a non-positive or material-actuated connection is provided; in the latter case, a positive connection is provided on the basis of a beaded edge 50''.

Although other modifications and changes may be suggested by those skilled in the art, it is the intention of the inventors to embody within the patent warranted hereon all changes and modifications as reasonably and properly come within the scope of their contribution to the art.

I claim:

1. An injection valve for injecting fuel into an intake line of an internal-combustion engine, comprising:

a valve body that has an annular valve seat at an inside of the injection valve, said valve body being concentric with a principle axis;

a closing part mounted for displacement along the principle axis, said closing part being flat;

a spring mounted to press said closing part against said valve seat;

an electromagnet mounted to lift said closing part of said valve seat;

a cylindrical conduit that penetrates said valve body inside said valve seat from inside to outside, said conduit being cylindrical and of constant diameter;

through which said conduit discharges to outside said valve body, said nozzle opening being formed by a central opening, and peripheral openings that surround said central opening and expand toward the outside, guide tabs separating said peripheral openings from one another;

said peripheral openings and said guide tabs lying in an annular zone that is arranged between said central opening and an end of said conduit and that describes an acute angle of inclination of less than 90° with the principle axis.

2. An injection valve according to claim 1, wherein said guide tabs occupy at least 30% of an area of said annular zone.

3. An injection valve according to claim 2, wherein said nozzle opening lies coaxially with the principle axis.

4. An injection valve according to claim 3, wherein every one of said peripheral openings is symmetrical relative to a secondary axis, said secondary axes of all of said peripheral openings proceeding from the principle axis and having the same angular spacing from one another.

5. An injection valve according of claim 4, wherein three of said peripheral openings are formed in said nozzle opening, and said angular spacing between said peripheral openings is substantially equal to 120°.

6. An injection valve according to claim 4 wherein, an end of every one of said peripheral openings is limited by a semicircular end wall.

7. An injection valve according to claim 6, wherein each of said peripheral openings has two lateral edges lying opposite one another and proceeding between said end wall of every one of said peripheral openings and said central opening.

8. An injection valve according to claim 6, wherein each of said peripheral openings has lateral edges formed as circular arcs; and said lateral edges of neighboring ones of said peripheral openings reach said central opening at a distance from one another.

9. Injection valve according to claim 8, characterized in that the lateral edges (5311') are circular arcs; and in that the lateral edges (5311') of neighboring peripheral openings (531') reach the circular central opening (530') at a distance from one another.

10. An injection valve according to claim 1, further comprising:

a separate nozzle member that is secured to said valve body, said separate nozzle member including said annular zone and said nozzle opening.

11. An injection valve according to claim 10, wherein said separate nozzle member is a pressure diecast part.

* * * * *